US007211759B2

(12) United States Patent
Chou

(10) Patent No.: US 7,211,759 B2
(45) Date of Patent: May 1, 2007

(54) SWITCH COUPLING STRUCTURE

(75) Inventor: Chin-Wen Chou, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 11/227,116

(22) Filed: Sep. 16, 2005

(65) Prior Publication Data

US 2007/0062798 A1 Mar. 22, 2007

(51) Int. Cl.
*H01H 5/18* (2006.01)

(52) U.S. Cl. ..... 200/461; 200/293

(58) Field of Classification Search ..... 200/293, 200/440, 302.1–303, 405–409, 442, 451, 200/453, 459–461, 520
See application file for complete search history.

(56) References Cited

U.S. PATENT DOCUMENTS 4,628,166 A * 12/1986 Bingo et al. ..... 200/302.1
5,453,590 A * 9/1995 Mayer ..... 200/461
5,461,207 A * 10/1995 Van Lear ..... 200/81 H
5,610,676 A * 3/1997 Nakazawa ..... 396/355
5,717,177 A * 2/1998 Tsai et al. ..... 200/16 R
5,734,136 A * 3/1998 Newcomer et al. ..... 200/5 A
5,875,887 A * 3/1999 Tsai ..... 200/461
6,713,702 B1 * 3/2004 Lee ..... 200/520
7,041,922 B2 * 5/2006 Geiger et al. ..... 200/296

FOREIGN PATENT DOCUMENTS

TW 458358 A 10/2001
TW 484748 A 4/2002
TW 515561 A 12/2002
TW 531036 A 5/2003

* cited by examiner

*Primary Examiner*—Michael A. Friedhofer
*Assistant Examiner*—Lisa Klaus
(74) *Attorney, Agent, or Firm*—Birch, Stewart, Kolasch & Birch, LLP

(57) ABSTRACT

A switch coupling structure includes a cap and a seat that are coupled to form a housing chamber inside to hold switch elements. The cap and seat have a coupling surface. The cap and seat have respectively a first fastening portion and a second fastening portion formed in a mating convex and concave fashion corresponding to the coupling surface. The first and second fastening portions are partly or entirely covered by a bonding material so that they are bonded together without the bonding material overflowing inside or outside the switch. Hence no interference occurs to the switch elements.

15 Claims, 10 Drawing Sheets

SWITCH COUPLING STRUCTURE

FIELD OF THE INVENTION

The present invention relates to a switch coupling structure and particularly to a switch coupling structure which includes a cap and a seat that have mating fastening portions formed in a convex and concave fashion on a coupling surface to facilitate a secured coupling.

BACKGROUND OF THE INVENTION

The conventional switch case generally includes a cap and a seat that are coupled through tenons and mortises as shown in FIG. 1 to form a housing chamber inside to hold switch elements. Such a structure has drawbacks, notably: 1. The tenons and mortises have tolerances which make coupling of the cap and seat not precise and firm, and loose coupling occurs; 2. As the cap and seat have tolerances on the coupling surface, moisture tends to enter the switch and results in damage of the conductive elements in the switch; 3. Expensive molds have to be made to produce the mating tenons and mortises, hence the cost is higher.

FIG. 2 illustrates another conventional switch. It has a cap and a seat fastened through a bonding material on the coupling surface. Such a structure can prevent the moisture from entering the switch so that the conductive elements are less likely to be damaged. The production cost also is lower. However, to evenly dispense the bonding material on the bonding surface is difficult, and the bonding material easily overflows from the flat bonding surface under pressure during fastening process to smear the interior or exterior of the switch. The switch elements could be tampered and malfunction or result in poor contact. The production yield could suffer and the production cost could increase.

R.O.C. patent publication No. 484748 discloses a waterproof switch which includes a hollow base with an open end and a pushbutton located on the open end. The inner wall of the base at the open end has at least one jutting detent wall, and the inner walls of the detent wall and the base are interposed by a trough. The trough has at least one channeling port directing outwards to discharge unwanted liquid and external material. It is waterproof and can prevent liquid and external material from entering the switch. But the air contains moisture which still can seep into the switch. Hence how to develop a switch with a case which can be coupled firmly to fend off moisture and reduce damage of the conductive elements in the switch is an issue remained to be resolved in the industry.

Other references of switch with the seat and cap coupled through latches can be found in R.O.C. patent publication Nos. 531036, 515561 and 458358.

SUMMARY OF THE INVENTION

The primary object of the present invention is to solve the aforesaid disadvantages. The invention provides a switch which includes a cap and a seat that are coupled to form a housing chamber to hold switch elements. The cap and seat include a first fastening portion and a second fastening portion that are formed in a mating convex and concave fashion on a coupling surface. The first and second fastening portions are partly or entirely covered by a bonding material to bond the cap and seat and form a sealed switch.

Another object of the invention is to provide a switch that has the cap and seat bonded by the bonding material without overflowing outside the first and second fastening portions.

The first and second fastening portions on the coupling surface have an equal coupling area, or the concave fastening portion is larger than the convex fastening portion. And the second fastening portion has a depth greater than the length of the first fastening portion. Hence when the first and second fastening portions are coupled on the coupling surface, an additional space is formed between the first and second fastening portions to contain the extra bonding material and prevent the bonding material from overflowing.

Yet another object of the invention is to provide a waterproof switch. Through the first and second fastening portions that have mating convex and concave fastening portions, moisture is less likely to enter the switch. Moreover, the interior of the switch is sealed because of the two fastening portions are bonded by the bonding material, moisture cannot enter the switch.

Another object of the invention is to increase the bonding area of the cap and seat to enhance the bonding effect. With the first and second fastening portions formed in a mating convex and concave fashion, the contact surface is larger. Hence the surface covered by the bonding material also is greater. As a result, the bonding effect is enhanced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
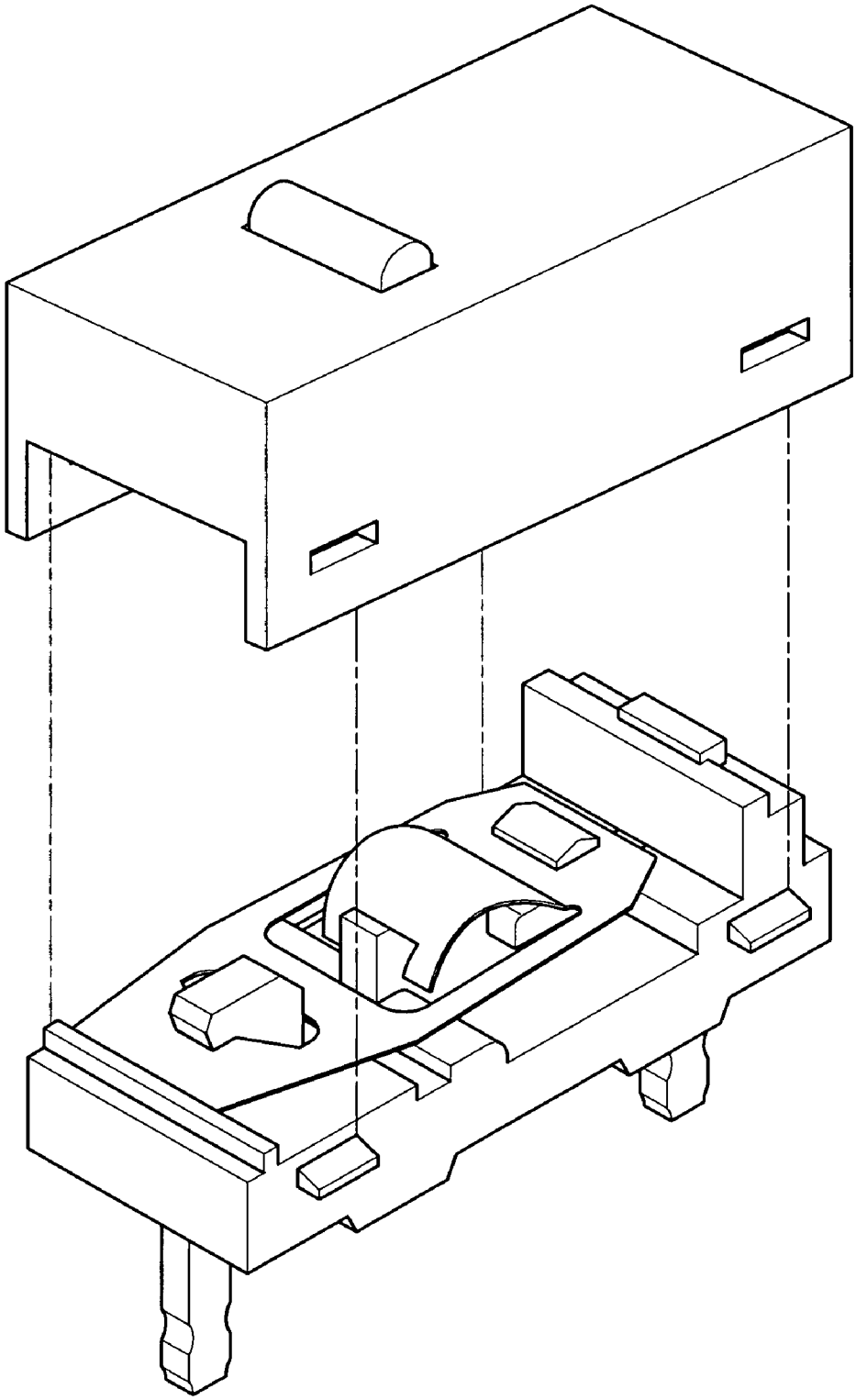
Fig. 1 PRIOR ART
FIG. 1 is an exploded view of a conventional switch.
Figure 2:
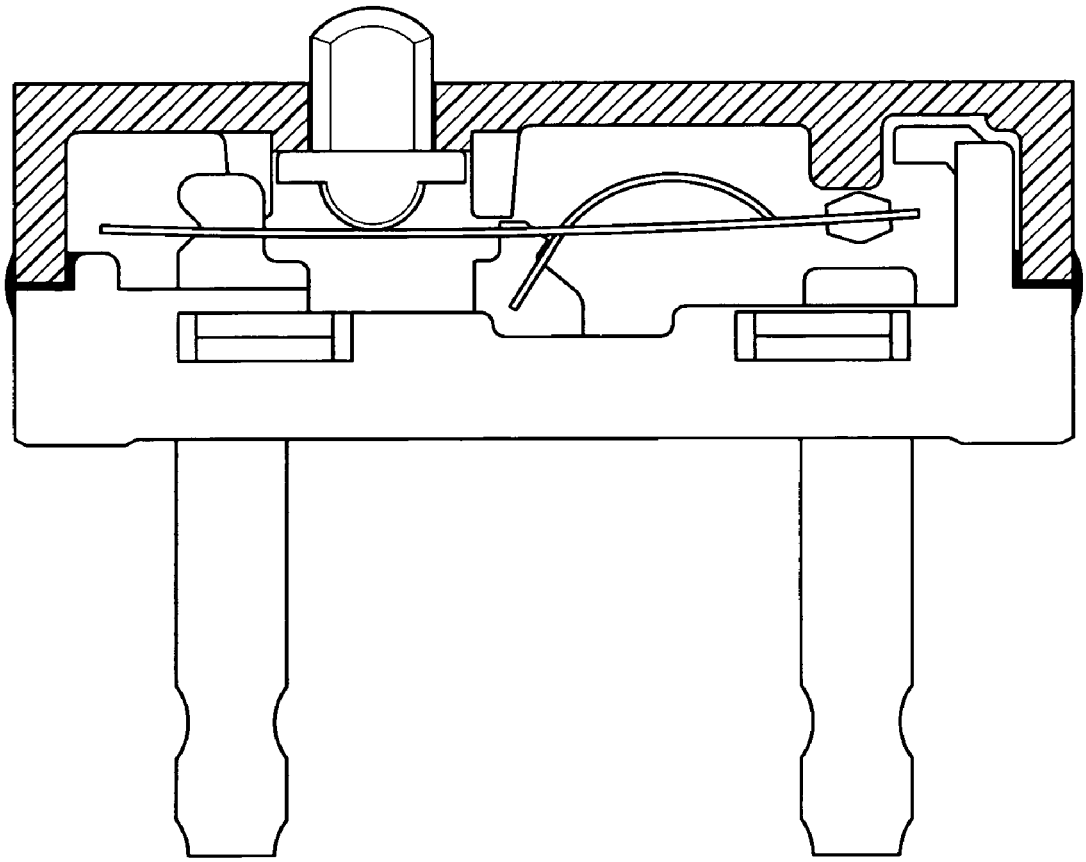
Fig. 2 PRIOR ART
FIG. 2 is a side view of another conventional switch partly cut away.
Figure 3:
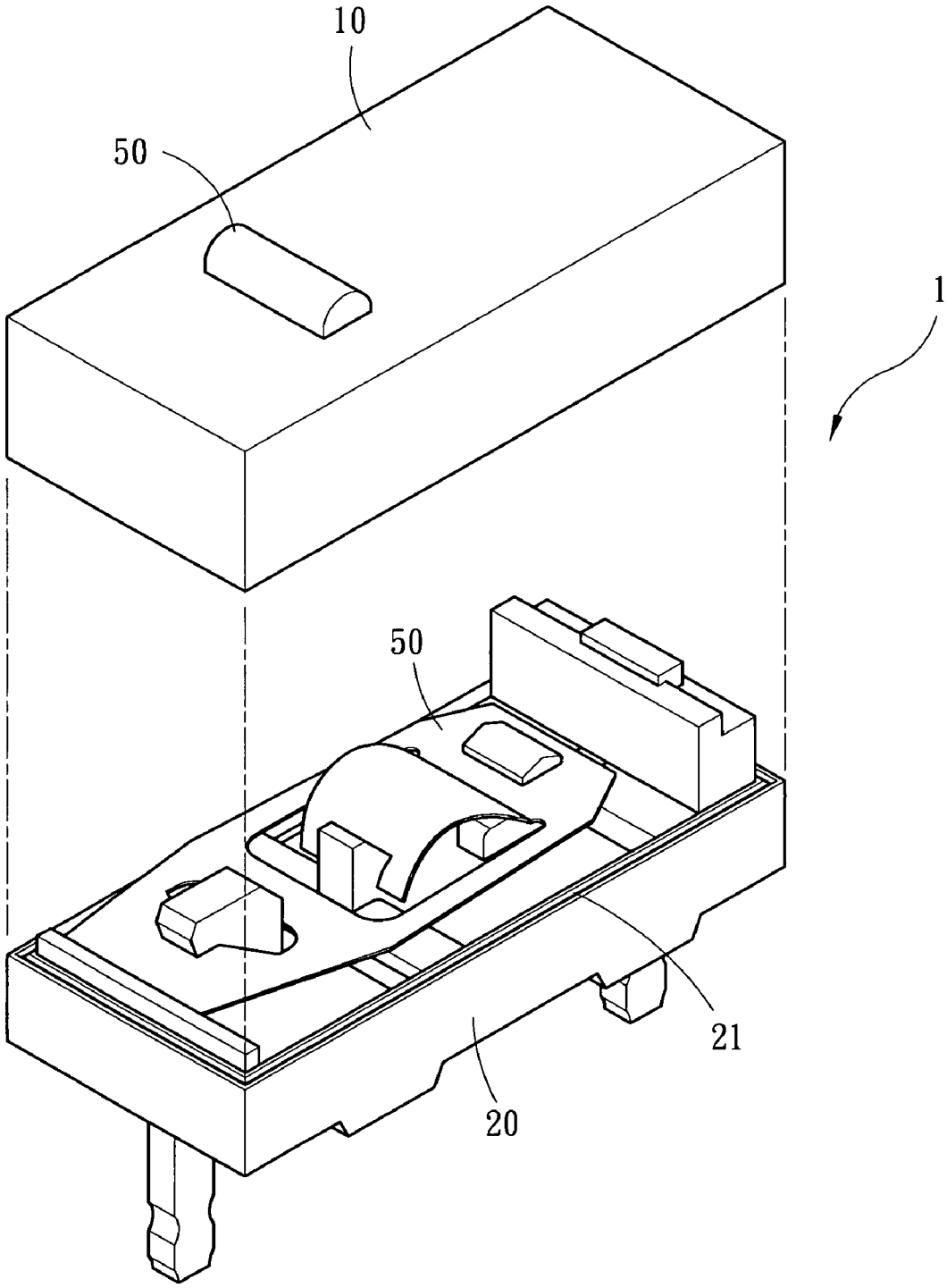
FIG. 3 is an exploded view of the present invention.
Figure 4A:
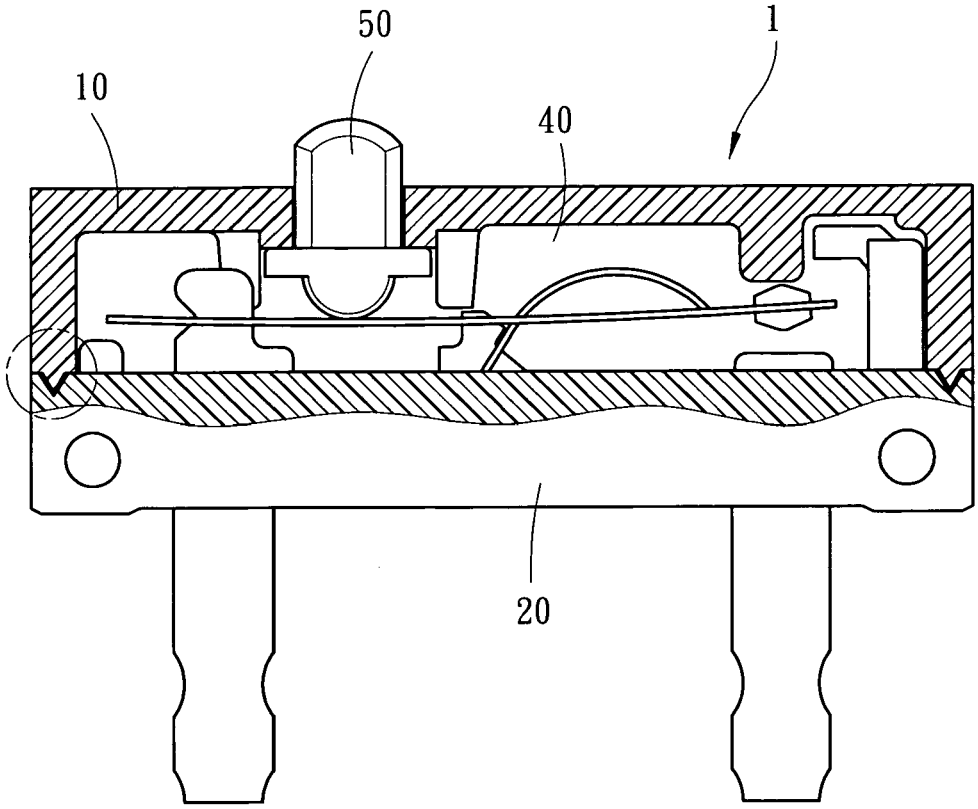
FIG. 4A is a sectional view of the present invention.
Figure 4B:
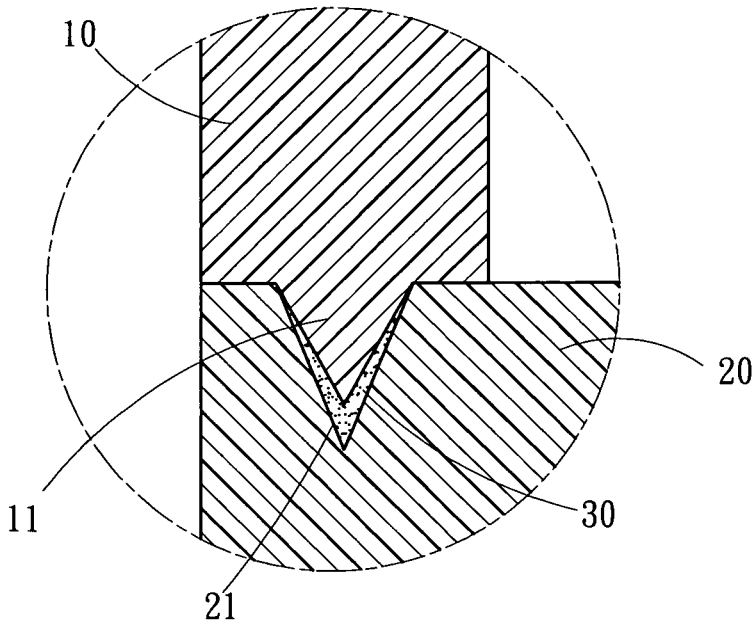
FIG. 4B is a fragmentary enlarged view of the present invention.
Figure 5:
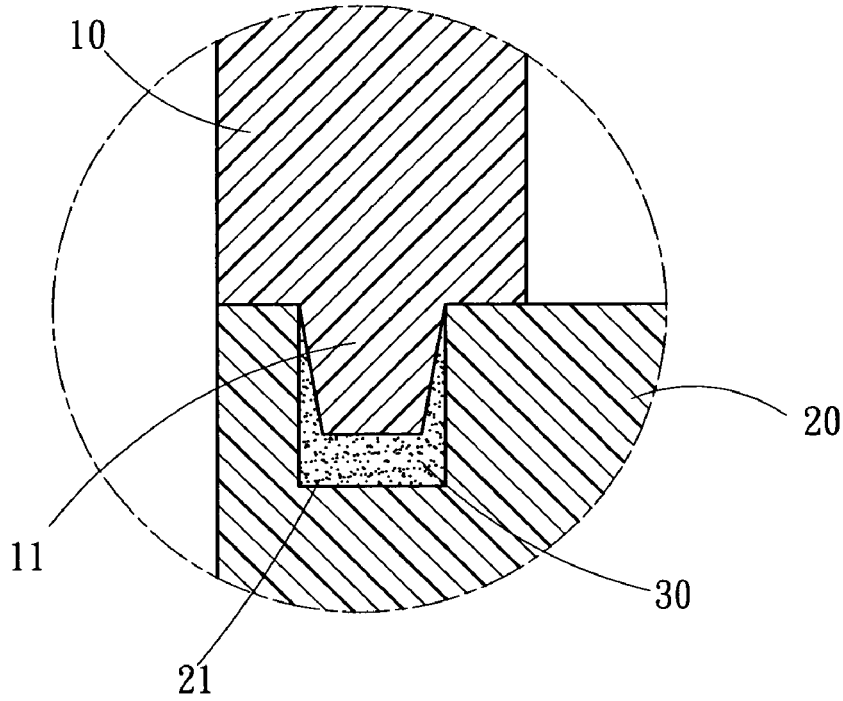
FIG. 5 is a schematic view of an embodiment of the invention.

Please referring to FIGS. 3, 4A and 4B, the switch 1 according to the invention includes a cap 10 and a seat 20 that are coupled together to form a housing chamber 40 inside to hold switch elements 50. The seat 20 and cap 10 form a coupling surface after fastened. The cap 10 and seat 20 have respectively a first fastening portion 11 and a second fastening portion 21 that are formed in a convex and concave fashion to mate each other for coupling. Either the first fastening portion 11 or second fastening portion 21 is covered by a bonding material 30, or both the fastening portions 11 and 21 are covered by the bonding material 30 as shown in FIG. 4B. After the first fastening portion 11 of the cap 10 (referring to the drawings, the first fastening portion 11 is extended from the cap 10. However this is not the limitation. It can also be extended from the seat 20) is covered by the bonding material 30, it can be coupled with the second fastening portion 21 of the seat 20 (the bonding material 30 may also be dispensed on the second fastening portion 21 rather than on the first fastening portion 11) to enable the cap 10 and the seat 20 to be fastened to become the switch 1. By bonding the first fastening portion 11 and the second fastening portion 21 through the bonding material 30, the switch 1 is sealed tightly. Hence the moisture in the air does not seep into the switch 1 through the coupling surface of the cap 10 and the seat 20. The switch elements inside the switch 1 can be protected without damaging.

Refer to FIGS. 5, 7A, 7B and 7H for various embodiments of the invention. The first fastening portion 11 and the second fastening portion 21 have the same area on the coupling surface. But the depth of the second fastening portion 21 is greater than or equal to the length of the first fastening portion 11. Hence when the two fastening portions are coupled and fastened, an additional overflow space is formed to hold the extra bonding material 30. It is to be noted that the first fastening portion 11 and the second fastening portion 21 are formed in desired profiles to create an overflow space to hold extra bonding material 30. Hence the extra bonding material 30 does not overflow inside and outside the switch 1, and does not smear and affect the switch elements inside and outside.

Figure 6:
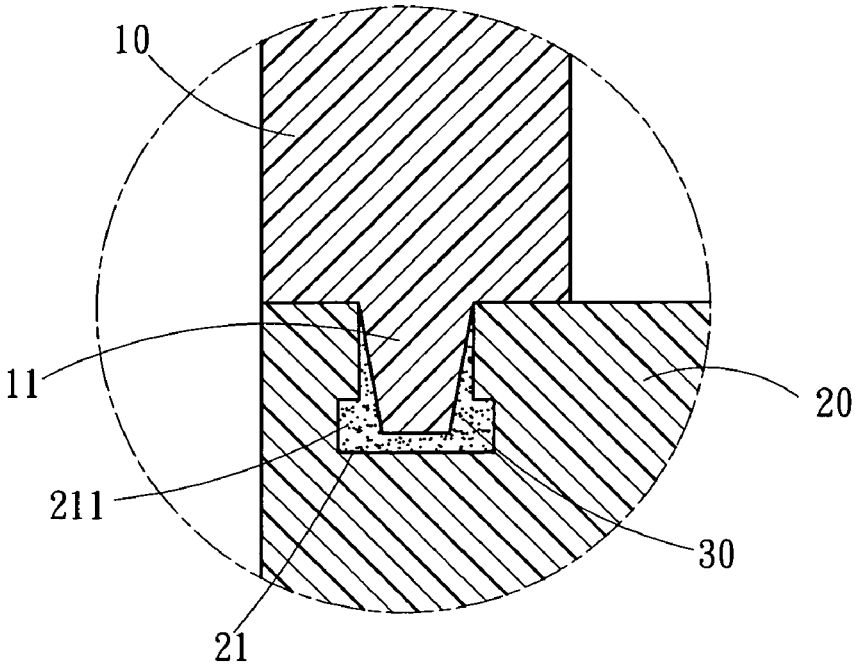
FIG. 6 is a schematic view of another embodiment of the invention.
Figure 7A:
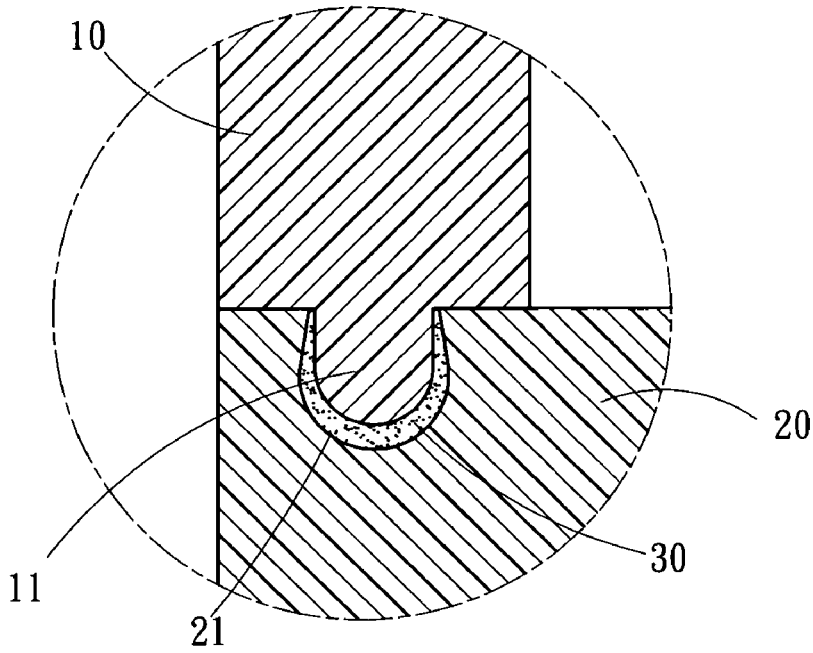
FIGS. 7A through 7H are schematic views of various other embodiments of the present invention.
Figure 7B:
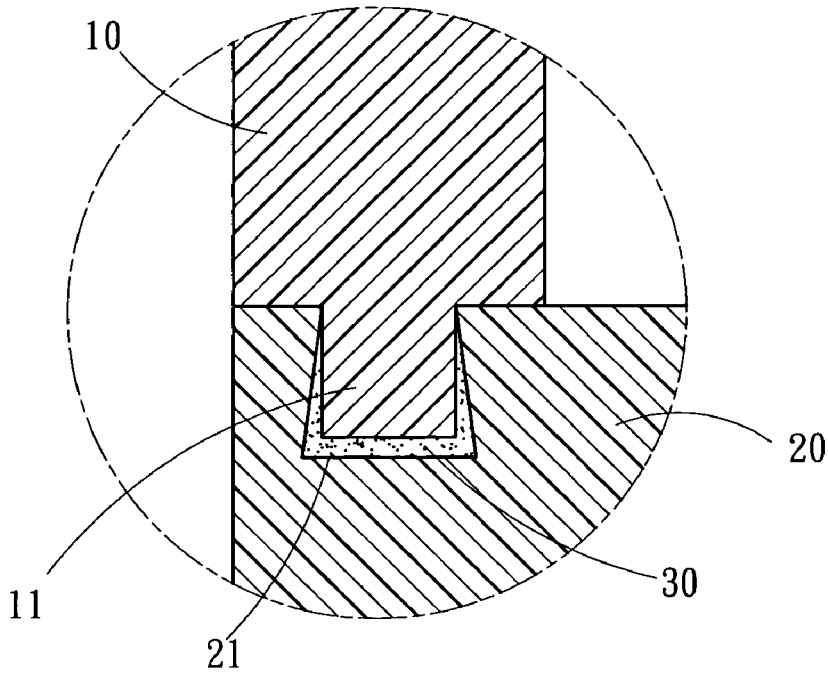
Figure 7C:
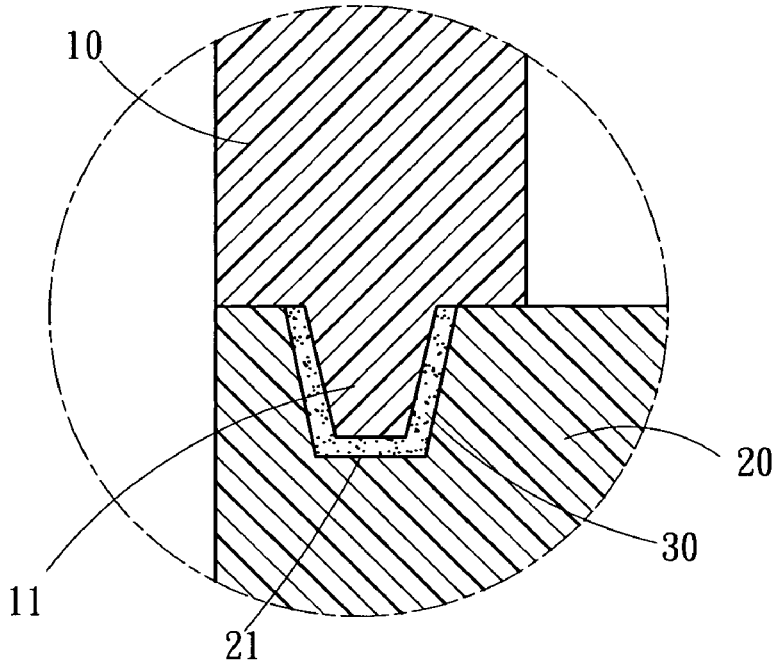
Figure 7D:
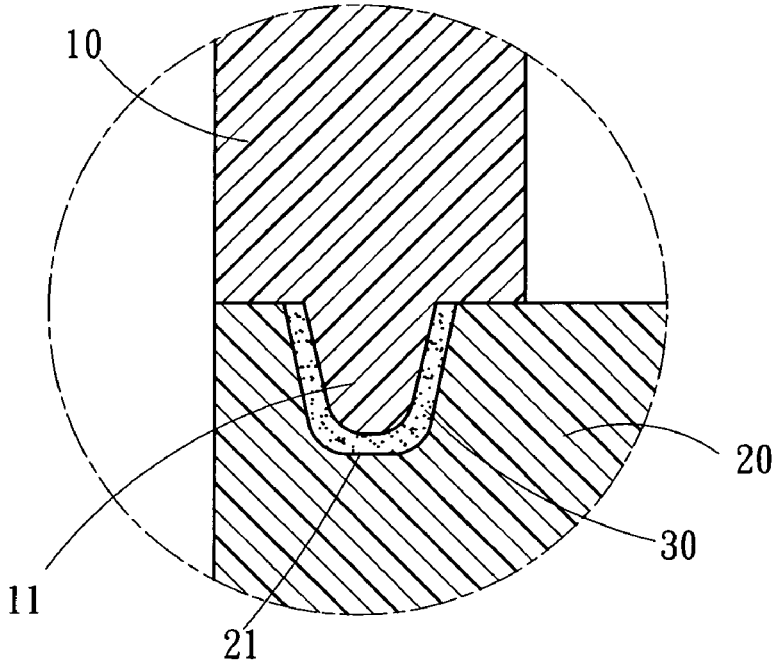
Figure 7E:
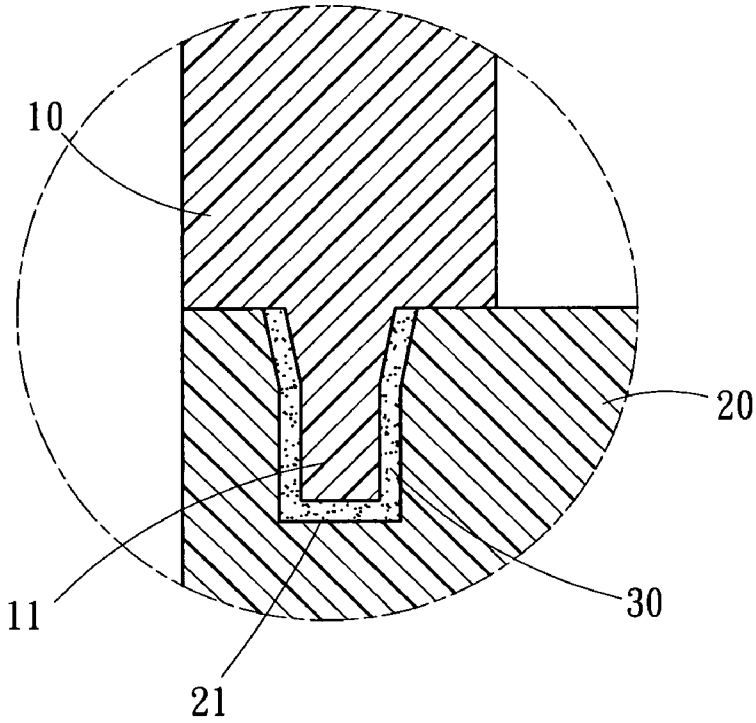
Figure 7F:
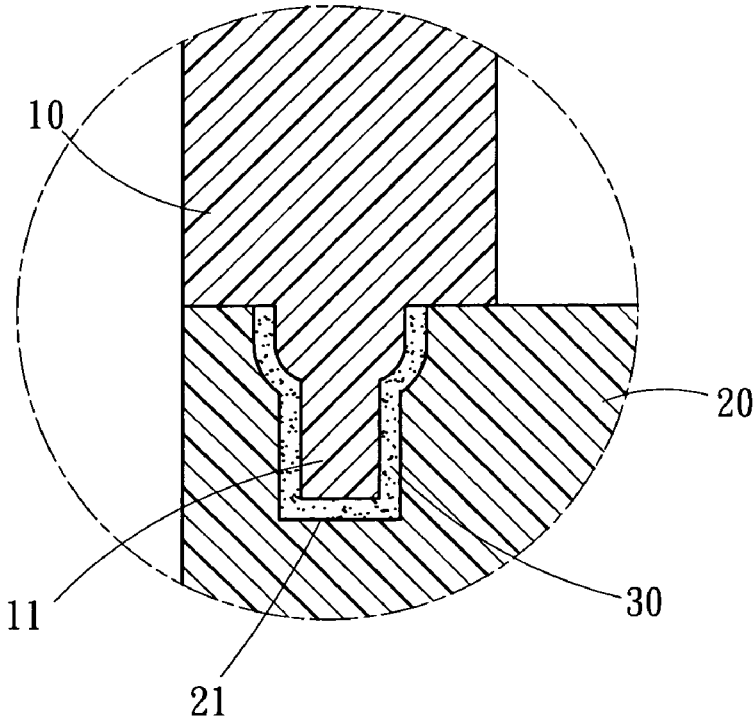
Figure 7G:
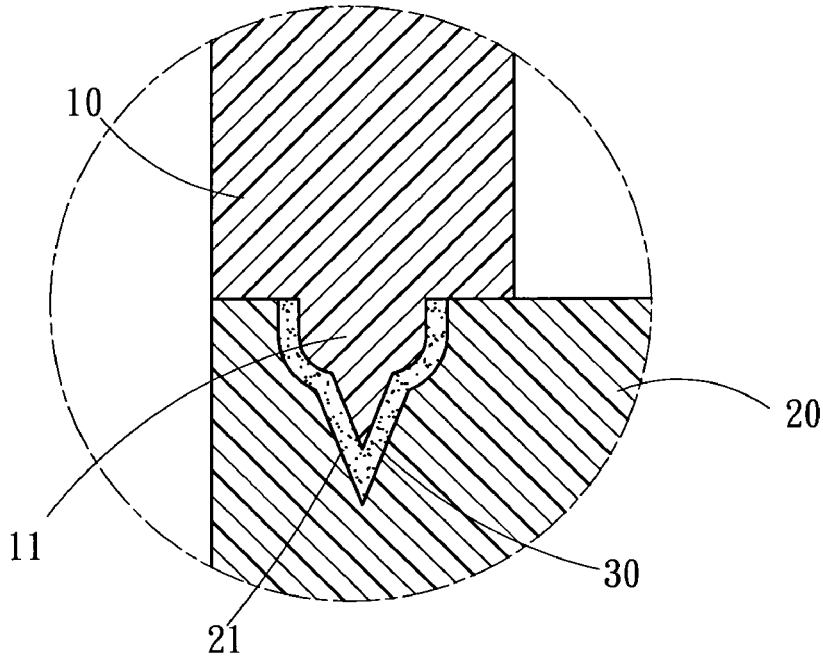
Figure 7H:
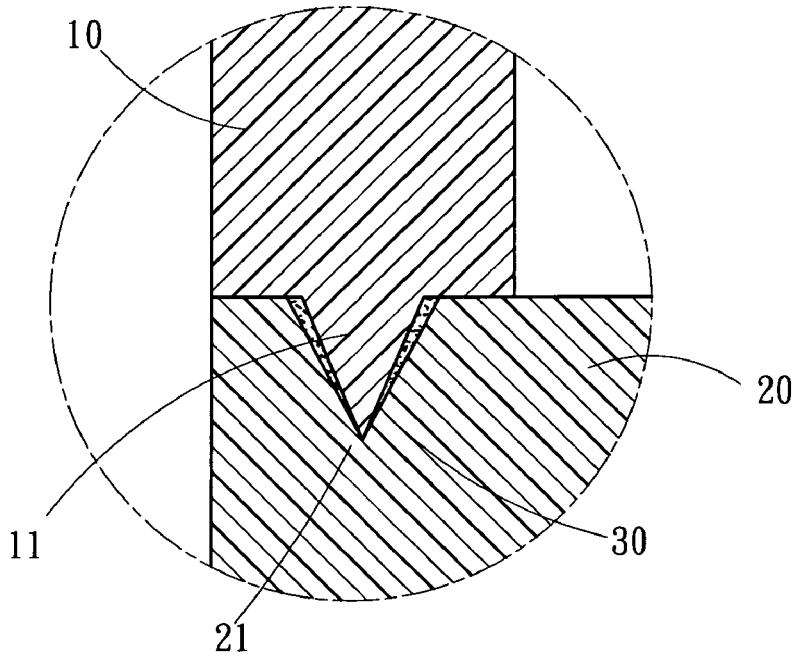

Refer to FIG. 6 for an embodiment of the invention. The indented second fastening portion 21 has a transverse trough 211 (The trough may also be formed other than transverse). Hence the bonding material 30 can be stored before coupling of the two fastening portions 11 and 21. During installation, the convex first fastening portion 11 squeezes the bonding material 30 held in the second fastening portion 21 so that the bonding material 30 is diffused to fill the space formed between the first and second fastening portions 11 and 21, and spreads to cover the surfaces of the first and second fastening portions 11 and 21. Thus by dispensing the bonding material 30 in advance into the second fastening portion 21, the diffusion range the bonding material 30 can be controlled without overflowing outside or inside the switch 1.

Refer to FIGS. 7C through 7G for other embodiments of the invention. The first fastening portion 11 and the second fastening portion 21 are located on the coupling surface but have different areas (however can be coupled together). The length of the second fastening portion 21 is greater than the first fastening portion 11 so that an overflow space is formed to hold the extra bonding material 30 when they are coupled together. The size of the convex fastening portion is smaller than the concave fastening portion, hence a larger overflow space can be formed for the bonding material 30. Therefore the extra bonding material 30 can be held in the overflow space without overflowing outside and inside the switch 1.

Figure 8:
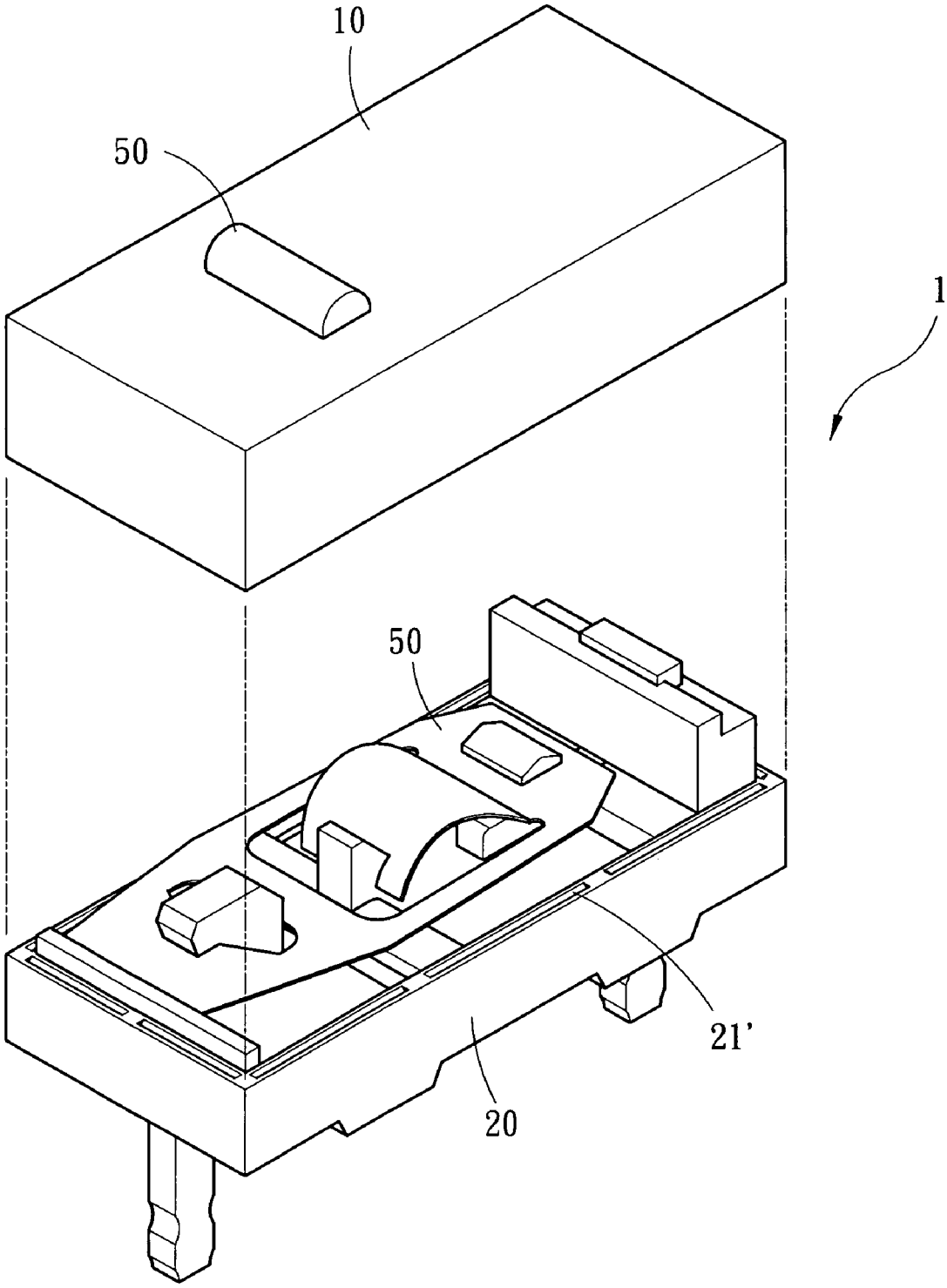
FIG. 8 is a schematic view of yet another embodiment of the present invention.

In summary, the main features of the invention include: the cap 10 and seat 20 are coupled to form a housing chamber 40 inside; the cap 10 and the seat 20 have respectively a first fastening portion 11 and a second fastening portion 21 that are formed in a convex and concave fashion mating each other to form coupling; either or both the first and second fastening portions 11 and 21 are covered by a bonding material 30; and the concave fastening portion may have a trough 211 on the bottom to store the bonding material 30. The invention aims to prevent the bonding material 30 from overflowing inside and outside the switch 1 so that other elements are not smeared or affected. The convex and concave profiles of the fastening portions can increase the bonding area of the cap 10 and seat 20 to enhance the bonding effect. Moreover, the coupling surface which entirely surrounds the first and second fastening portions 11 and 21 can seal the switch 1 to prevent the moisture from seeping into the switch 1 through the coupling surface. The convex and concave fastening portions may be formed in various profiles as shown in FIGS. 4B, 5, 7A through 7H. The cross section of the convex fastening portion also may have many different choices. The concave fastening portion is formed in a profile mating the cross section of the convex fastening portion. As shown in FIG. 6, the concave fastening portion may have a trough 211 to prevent overflow of extra bonding material 30. In addition, coupling of the cap 10 and seat 20 is not limited to covering the entire periphery. As shown in FIG. 8, the fastening portions 11 and 21 may also be formed in sections and spaced from each other to achieve the bonding effect for the cap 10 and seat 20. All the features previously discussed are adaptable to coupling and fastening of switches. The switches thus formed have significant advantages over the conventional switches.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A switch coupling structure comprising a cap and a seat that are coupled together to form a housing chamber to hold switch elements;

wherein the cap and the seat form a coupling surface, the cap having a first fastening portion and the seat having a second fastening portion that correspond to the coupling surface and are formed respectively in a convex and concave fashion mating with each other, the first fastening portion and the second fastening portion being partly or entirely covered by a bonding material to form a firm fastening and the first fastening portion and the second fastening portion avoiding overflow of the bonding material therefrom.

2. The switch coupling structure of claim 1, wherein the first fastening portion and the second fastening portion have a same area on the coupling surface, the second fastening portion having a depth greater than the length of the first fastening portion.

3. The switch coupling structure of claim 1, wherein the first fastening portion and the second fastening portion have a same area on the coupling surface, the second fastening portion having a depth equal to the length of the first fastening portion.

4. The switch coupling structure of claim 1, wherein the first fastening portion has a smaller area than the second fastening portion on the coupling surface, the second fastening portion having a depth greater than the length of the first fastening portion.

5. The switch coupling structure of claim 1, wherein the first fastening portion has a smaller area than the second fastening portion on the coupling surface, the second fastening portion having a depth equal to the length of the first fastening portion.

6. The switch coupling structure of claim 1, wherein the second fastening portion has a trough formed therein.

7. The switch coupling structure of claim 6, wherein the trough extends parallel to a longitudinal axis of the second fastening portion and wherein the trough extends outwardly from at least one wall of the second fastening portion to form at least one bulge in the second fastening portion.

8. The switch coupling structure of claim 1, wherein the first fastening portion and the second fastening portion have respectively a square cross section.

9. The switch coupling structure of claim 1, wherein the first fastening portion and the second fastening portion have respectively a trapezoidal cross section.

10. The switch coupling structure of claim 1, wherein the first fastening portion and the second fastening portion have respectively a curved cross section.

11. The switch coupling structure of claim 1, wherein the first fastening portion and the second fastening portion have respectively a triangular cross section.

12. The switch coupling structure of claim 1, wherein the first fastening portion and the second fastening portion have respectively a trapezoidal cross section which has an arched short side.

13. The switch coupling structure of claim 1, wherein the first fastening portion and the second fastening portion have respectively a trapezoidal cross section which has one side extended to form a square.

14. The switch coupling structure of claim 1, wherein the first fastening portion and the second fastening portion have respectively a curved cross section which has one end extended to form a square.

15. The switch coupling structure of claim 1, wherein the first fastening portion and the second fastening portion have respectively a curved cross section which has one end extended to form a triangle.

* * * * *